US009574536B2

(12) United States Patent
Oohata et al.

(10) Patent No.: US 9,574,536 B2
(45) Date of Patent: Feb. 21, 2017

(54) FUEL INJECTOR

(71) Applicant: DENSO CORPORATION, Kariya, Aichi-pref (JP)

(72) Inventors: Keigo Oohata, Kariya (JP); Eiji Ito, Anjo (JP)

(73) Assignee: DENSO CORPORATION, Kariya (JP)

( * ) Notice: Subject to any disclaimer, the term of this patent is extended or adjusted under 35 U.S.C. 154(b) by 158 days.

(21) Appl. No.: 14/082,794

(22) Filed: Nov. 18, 2013

(65) Prior Publication Data

US 2014/0137841 A1 May 22, 2014

(30) Foreign Application Priority Data

Nov. 20, 2012 (JP) ..... 2012-254488
Aug. 23, 2013 (JP) ..... 2013-173673

(51) Int. Cl.
*F02M 61/14* (2006.01)
*F02M 55/00* (2006.01)

(52) U.S. Cl.
CPC ..... *F02M 61/14* (2013.01); *F02M 55/004* (2013.01); *F02M 2200/02* (2013.01); *F02M 2200/16* (2013.01)

(58) Field of Classification Search
CPC . F02B 23/101; F02M 61/14; F02M 2200/858; F02M 2200/16; F02M 55/002; F02M 2200/02; F02M 55/004
USPC ..... 123/470, 471, 445, 467
See application file for complete search history.

(56) References Cited

U.S. PATENT DOCUMENTS 4,267,977 A * 5/1981 Stockner et al. ..... 239/132.3
5,348,229 A * 9/1994 Wood ..... F02M 51/0671 239/132
5,752,487 A 5/1998 Harrell et al.
6,178,950 B1 1/2001 Stockner et al.
6,193,238 B1 2/2001 Sporre
6,223,727 B1 * 5/2001 Tahara ..... F02M 51/0671 123/470
6,481,421 B1 * 11/2002 Reiter ..... F02M 61/14 123/470
7,377,264 B2 * 5/2008 Buehner ..... F02M 61/14 123/467
7,484,499 B2 * 2/2009 Beardmore ..... F02M 61/14 123/470

(Continued)

FOREIGN PATENT DOCUMENTS

DE 10 321 163 12/2004
DE 10 2005 019313 11/2006

(Continued)

OTHER PUBLICATIONS

Office Action (2 pages) dated Mar. 17, 2015, issued in corresponding Japanese Application No. 2013-173673 and English translation (3 pages).

*Primary Examiner* — Long T Tran
(74) *Attorney, Agent, or Firm* — Nixon & Vanderhye P.C.

(57) ABSTRACT

A fuel injector includes a body having a fuel injection port, and a seal ring on the body. The body has a diameter-shrink portion of which an outer diameter is shrunk. The seal ring is engaged with the diameter-shrink portion. The diameter-shrink portion has a radially concaved annular groove with which a tip end portion of the seal ring is engaged. It is restricted that the seal ring is rubbed against an inner surface of the assembling hole and the seal ring is damaged.

16 Claims, 12 Drawing Sheets

(56) References Cited

U.S. PATENT DOCUMENTS

| | | | | |
|---|---|---|---|---|
| 7,559,312 | B2 * | 7/2009 | Brauneis | F02M 61/16 123/470 |
| 7,685,990 | B2 * | 3/2010 | Dingle | F02M 61/06 123/276 |
| 2002/0162538 | A1 | 11/2002 | Krause et al. | |
| 2002/0179057 | A1 | 12/2002 | Reiter et al. | |
| 2003/0150427 | A1 | 8/2003 | Liskow | |
| 2003/0155446 | A1 | 8/2003 | Reiter | |
| 2003/0168534 | A1 | 9/2003 | Hohl | |
| 2003/0178784 | A1 | 9/2003 | Nakayama et al. | |
| 2003/0183201 | A1 | 10/2003 | Hans | |
| 2004/0080115 | A1 | 4/2004 | Tsuchiya et al. | |
| 2007/0228193 | A1 * | 10/2007 | Kato | F02M 61/166 239/533.2 |
| 2007/0272214 | A1 | 11/2007 | Tsuchiya et al. | |
| 2008/0156298 | A1 * | 7/2008 | Brauneis | F02M 61/16 123/470 |
| 2008/0245340 | A1 * | 10/2008 | Beardmore | F02M 61/14 123/470 |
| 2008/0264390 | A1 | 10/2008 | Rottenwohrer et al. | |
| 2008/0314365 | A1 | 12/2008 | Daniel et al. | |
| 2010/0175668 | A1 * | 7/2010 | Chern | F02M 61/14 123/470 |
| 2011/0095222 | A1 * | 4/2011 | Flores | B24B 15/00 251/359 |
| 2011/0272495 | A1 * | 11/2011 | Nunic | F02M 61/14 239/533.2 |
| 2011/0303192 | A1 | 12/2011 | Jung et al. | |
| 2012/0217323 | A1 * | 8/2012 | Martinsson | B21D 53/84 239/533.2 |
| 2012/0298766 | A1 * | 11/2012 | Szparagowski | F02M 61/14 239/1 |

FOREIGN PATENT DOCUMENTS

| | | |
|---|---|---|
| EP | 2 080 893 | 7/2009 |
| JP | 2000-009000 | 1/2000 |
| JP | 2005-226517 | 8/2005 |
| JP | 2006-057563 | 3/2006 |
| JP | 2010-180969 | 8/2010 |

* cited by examiner

FUEL INJECTOR

CROSS-REFERENCE TO RELATED APPLICATION

This application is based on Japanese Patent Applications No. 2012-254488 filed on Nov. 20, 2012, and No. 2013-173673 filed on Aug. 23, 2013, the disclosures of which are incorporated herein by reference.

TECHNICAL FIELD

The present disclosure relates to a fuel injector injecting a fuel into an internal combustion engine.

BACKGROUND

In a configuration in which a body of a fuel injector is inserted into an assembling hole formed at a specified position of the internal combustion engine, it is required that no gas leaks from a fuel injection space (for example, a combustion chamber or an intake pipe) through a clearance between an inner surface of the assembling hole and an outer surface of the body.

Conventionally, an annular seal ring is disposed in the clearance. Specifically, as shown in JP-2005-155394A1 (US-2007-0272214A1), a diameter-shrink portion is formed on the body of the fuel injector, and the annular seal ring is provided on the diameter-shrink portion. Then, the body is inserted into the assembling hole.

However, in the conventional configuration, when the body is inserted into the assembling hole, the outer surface of the annular seal ring slides on the inner surface of the assembling hole along with a friction force. Due to the friction force, the annular seal ring may be pushed up and is displaced from the specified position of the diameter-shrink portion. If the body is further inserted into the assembling force, the annular seal ring is strongly rubbed between the inner surface of the assembling hole and the outer surface of the body. The annular seal ring may be damaged.

SUMMARY

It is an object of the present disclosure to provide a fuel injector in which a seal ring is not damaged.

According to the present embodiment, a fuel injector includes a body having a fuel injection port and a seal ring. The body has a diameter-shrink portion of which an outer diameter is shrunk. A seal ring is engaged with the diameter-shrink portion. When the body is inserted into an assembling hole, the seal ring seals a clearance between an outer surface of the body and an inner surface of an assembling hole. The diameter-shrink portion has a radially concaved annular groove with which a tip end portion of the seal ring is engaged.

Since the annular groove is formed on the diameter-shrink portion on which the seal ring is disposed, the body can be inserted into the assembling hole with the tip end portion engaged with the annular groove. Even if the outer surface of the seal ring is rubbed against the inner surface of the assembling hole, it is restricted that the seal ring may be pushed up. Since it is restricted that the seal ring is displaced from a specified position on the diameter-shrink portion, it is restricted that the seal ring is rubbed against the inner surface of the assembling hole and the seal ring is damaged.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Hereinafter, embodiments of a fuel injector will be described with reference to the drawings.

First Embodiment

Figure 1:
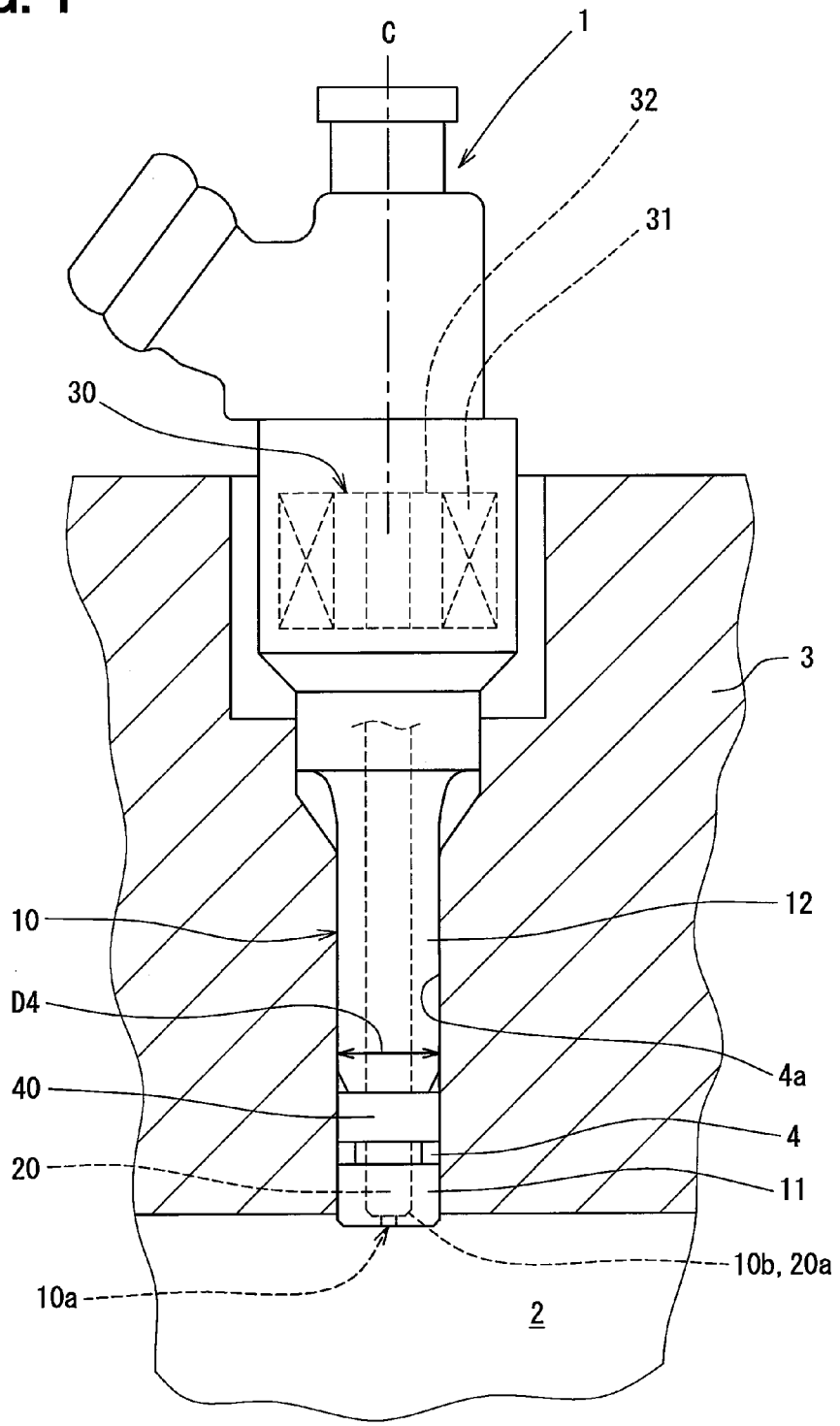
FIG. 1 is a construction diagram showing a fuel injector attached to an internal combustion engine according to a first embodiment.

As shown in FIG. 1, a fuel injector 1 is provided to an internal combustion engine (gasoline engine), and injects a fuel directly to the combustion chamber 2. A cylinder head 3 defines a combustion chamber 2. An assembling hole 4 is formed on a center line C of a cylinder. The fuel injector 1 is inserted into the assembling hole 4.

The fuel injector 1 has a body 10 which has a fuel passage and an injection port 10*a*. A valve body 20, an electric actuator 30 and the like are accommodated in the body 10. The valve body 20 has a valve seat surface 20*a* which contacts or separates a body seat surface 10*b* of the body 10. When the valve seat surface 20*a* contacts the body seat surface 10*b*, a fuel injection through the injection port 10*a* is terminated. When the valve seat surface 20*a* is lifted up from the body seat surface 10*b*, the fuel is injected through the injection port 10*a*.

The electric actuator 30 has a solenoid coil 31 and a fixed core 32. The fixed core 32 has a coil 31. When the coil 31 is energized, the fixed core 32 generates a magnetic attraction force which attracts the movable core (not shown) toward the fixed core 32. The valve body 20 is also lifted up with the movable core. When the coil 31 is deenergized, the valve body 20 sits on the body seat surface 10*b* by biasing force of a spring (not shown).

A seal ring 40 is provided on an outer surface of the body 10. The seal ring 40 seals a clearance between the outer surface of the body 10 and an inner surface 4*a* of the assembling hole 4. Thus, it is restricted that a gas in the combustion chamber 2 leaks outside through the clearance. The seal ring 40 is made from elastic material having a heat resistance. Specifically, the seal ring 40 is made from fluororesin.

Figure 2:
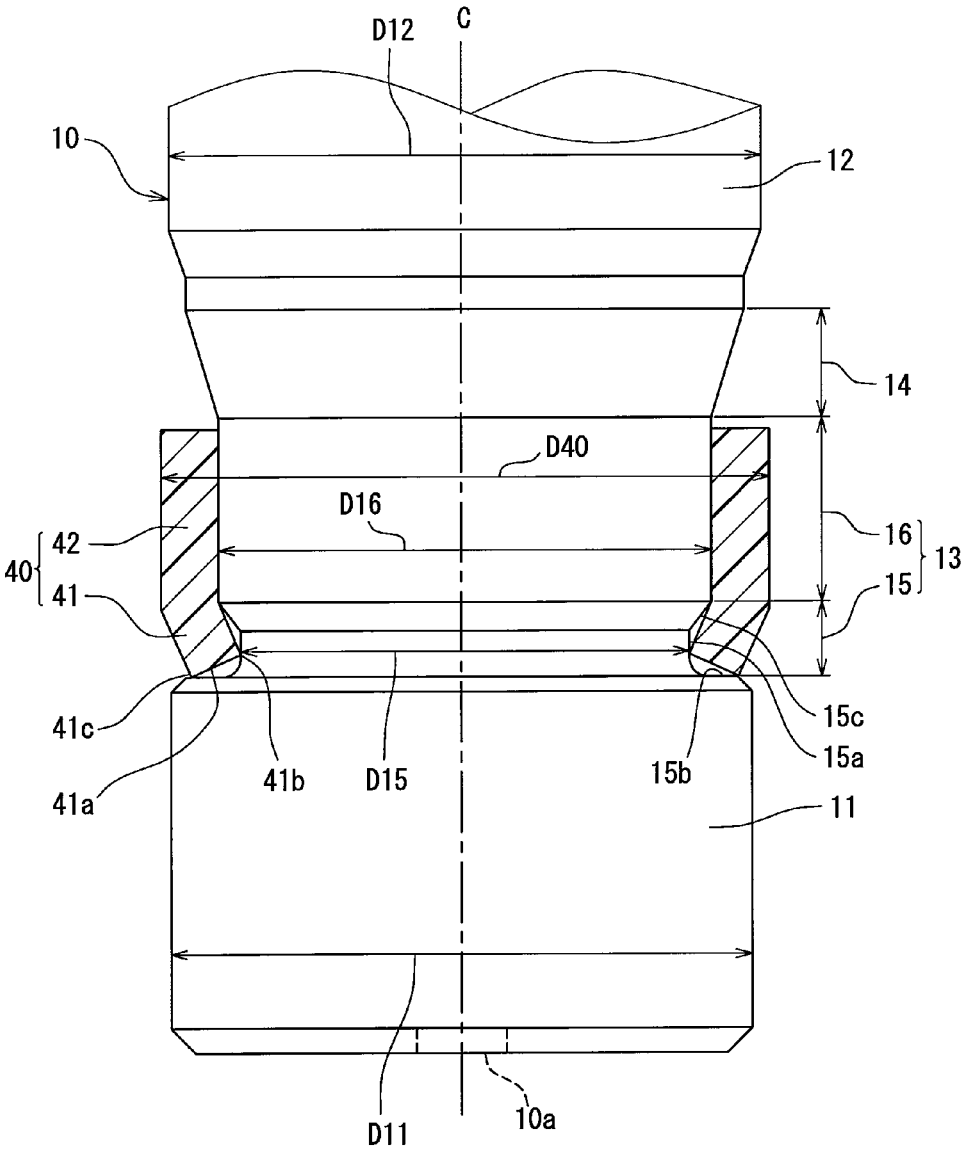
FIG. 2 is a chart showing a part of the fuel injector which is not assembled to an assembling hole according to the first embodiment.

FIG. 2 is an enlarged view of the fuel injector 1 which has not inserted into the assembling hole 4 yet. Referring to FIG. 2, configurations of the body 10 and the seal ring 40 will be described.

The body 10 is provided with an injection-port portion 11 having an injection port 10*a* and a base portion 12 accommodating the valve body 20. Further, the body 10 has a diameter-shrink portion 13 on which the seal ring 40 is disposed. The diameter-shrink portion 13 extends from the body 10 in a direction away from the injection port 10*a*. This direction is referred to as an anti-injection-port direction, hereinafter. A tapered portion 14 is formed adjacent to the diameter-shrink portion 13 in the anti-injection-port direction. That is, the body 10 has the injection-port portion 11, the diameter-shrink portion 13, the tapered portion 14 and the base portion 12 in this series from a tip end of the body 10.

An annular groove 15 is formed on the diameter-shrink portion 13 adjacent to the injection-port portion 11. A part of the diameter-shrink portion 13 on which the groove 15 is not formed is referred to as a base diameter-shrink portion 16. The seal ring 40 is disposed on the base diameter-shrink portion 16 and the annular groove 15.

An outer diameter D11 of the injection-port portion 11 is equal to an outer diameter D12 of the base portion 12. Outer diameters D15, D16 is smaller than the outer diameters D11, D12 of the injection-port portion 11 and the base portion 12. An outer diameter D15 of the annular groove 15 is smaller than an outer diameter D16 of the base diameter-shrink portion 16.

An outer diameter of the tapered portion 14 is gradually increased in the anti-injection-port direction. The outer diameter D16 of the base diameter-shrink portion 16 is constant. In the annular groove 15, a portion of which outer diameter is smallest is referred to as a bottom surface 15*a*, a portion between the bottom surface 15*a* and the injection-port portion 11 is referred to as a port-side surface 15*b*, and a portion between the bottom surface 15*a* and the base diameter-shrink portion 16 is referred to as a base-side surface 15*c*.

An outer diameter of the bottom surface 15*a* is constant. The base-side surface 15*c* is tapered in such a manner that its outer diameter gradually increases in the anti-injection-port direction. The port-side surface 15*b* is a flat surface which extends vertically relative to a shaft direction.

The seal ring 40 is disposed on both of the base diameter-shrink portion 16 and the annular groove 15. A tip end portion 41 of the seal ring 40 is engaged with the annular groove 15, and the other portion of the seal ring 40, which is referred to as a body portion 42, is disposed on the base diameter-shrink portion 16. The body portion 42 of the seal ring 40 may be elastically in contact with the base diameter-shrink portion 16. Alternatively, a clearance may be exist therebetween.

Before the seal ring 40 is assembled to the diameter-shrink portion 13, the seal ring 40 is cylindrical and its thickness is uniform. After the seal ring 40 is assembled to the diameter-shrink portion 13, the outer diameter of the body portion 42 is uniform. An outer diameter of the tip end portion 41 gradually decreases toward the injection port 10*a*. An end surface 41*a* of the tip end portion 41 is positioned in the annular groove 15.

The end surface 41*a* has an inner corner 41*b* and an outer corner 41*c*. The inner corner 41*b* is positioned on the bottom surface 15*a*, and the outer corner 41*c* is on the port-side surface 15*b*. The outer corner 41*c* is positioned radially inside of the outer surface of the injection-port portion 11. The outer surface of the body portion 42 of the seal ring 40 is positioned outside of the outer surface of the injection-port portion 11. That is, an outer diameter D40 of the body portion 42 is larger than the outer diameter D11 of the injection-port portion 11. The inner corner 41*b* may be in contact with the bottom surface 15*a*. Alternatively, the inner corner 41*b* may not be in contact with the bottom surface 15*a*. The outer corner 41*c* may be in contact with the port-side surface 15*b*. Alternatively, the outer corner 41*c* may not be in contact with the port-side surface 15*b*.

Figure 3:
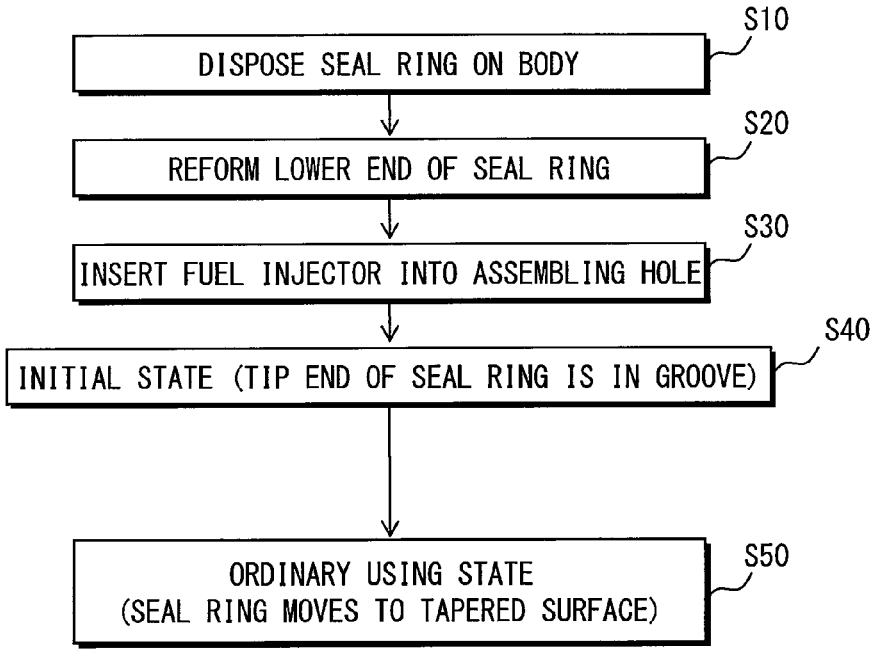
FIG. 3 is a diagram showing a procedure for assembling the fuel injector to the internal combustion engine according to the first embodiment.

Next, referring to FIG. 3, an assembling method for assembling the fuel injector 1, which has seal ring 40 on the body 10, into the assembling hole 4 will be described.

In step S10, the seal ring 40 is disposed on the body 10. The seal ring 40 is elastically radially deformed to be inserted to the diameter-shrink portion 13. At this moment, as shown in FIG. 4A, the tip end portion 41 has not formed yet. The outer diameter of the seal ring 40 is constant.

Figure 4B:
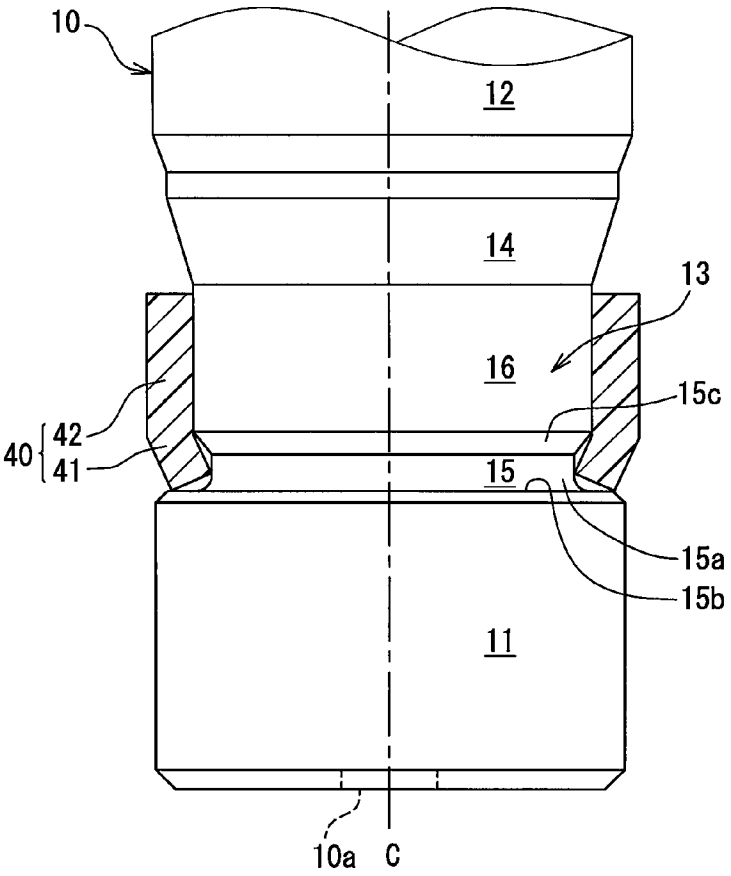
FIG. 4B is a chart showing a part of the fuel injector of which seal ring is reformed.
Figure 4A:
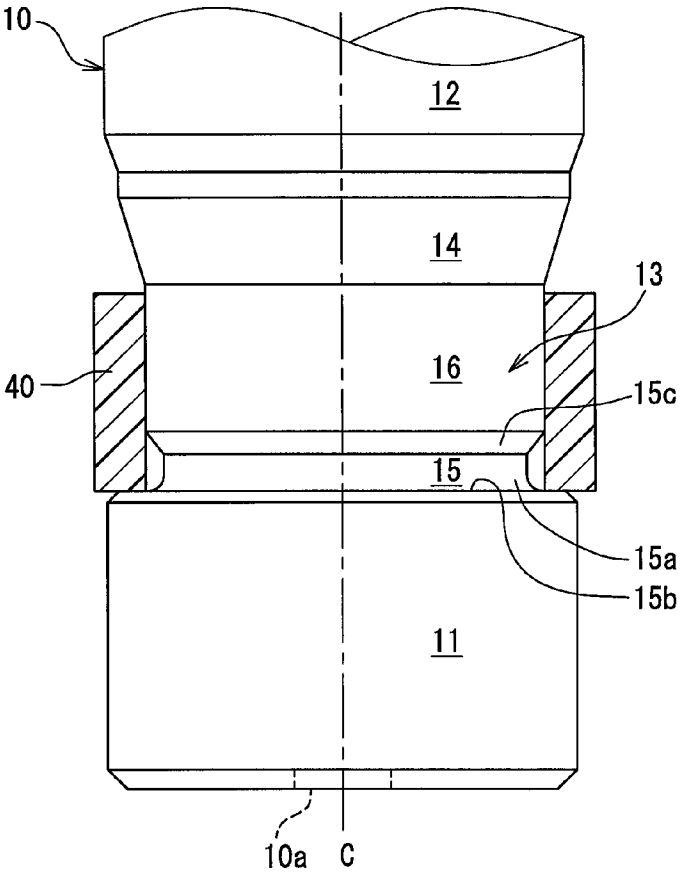
FIG. 4A is a chart showing a part of the fuel injector of which seal ring is before reforming.

Then, in step S20 (reform step), a lower end of the seal ring 40 is plastic deformed, so that the tip end portion 41 is formed as shown in FIG. 4B. For example, by using of a jig, the tip end portion 41 is bent inward to be engaged with the annular groove 15. Steps S10 and S20 correspond to a seal attaching step. The above plastic deformation of the seal ring 40 is referred to as a reformation.

Figure 5B:
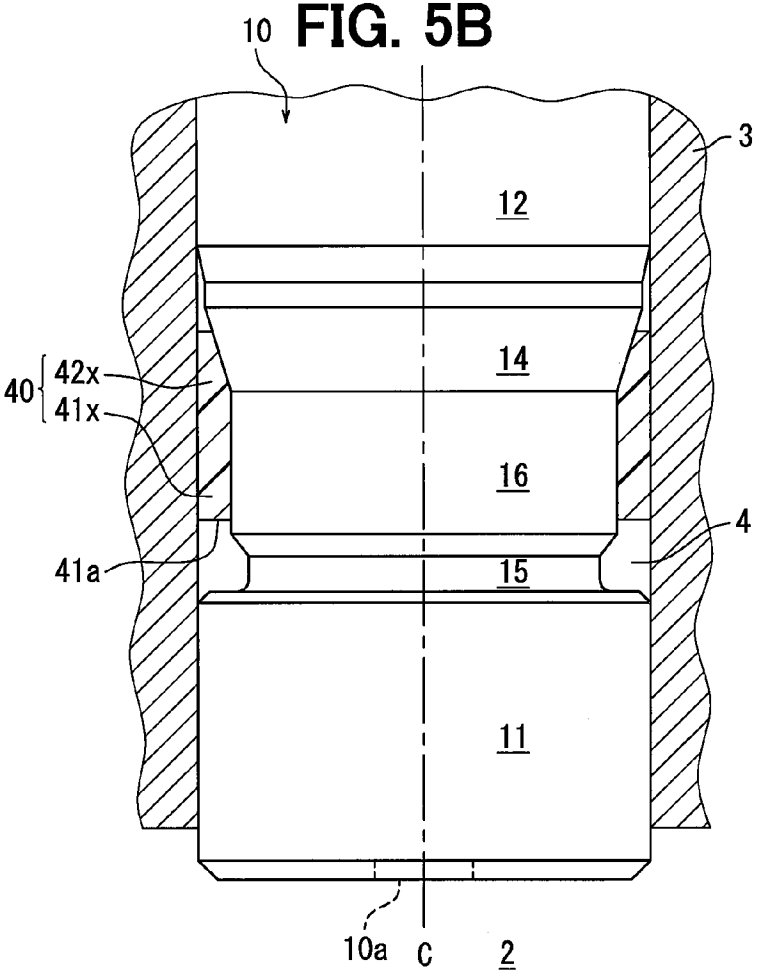
FIG. 5B is a chart showing an ordinary using state in which a gas-pressure is applied to the seal ring of the fuel injector.
Figure 5A:
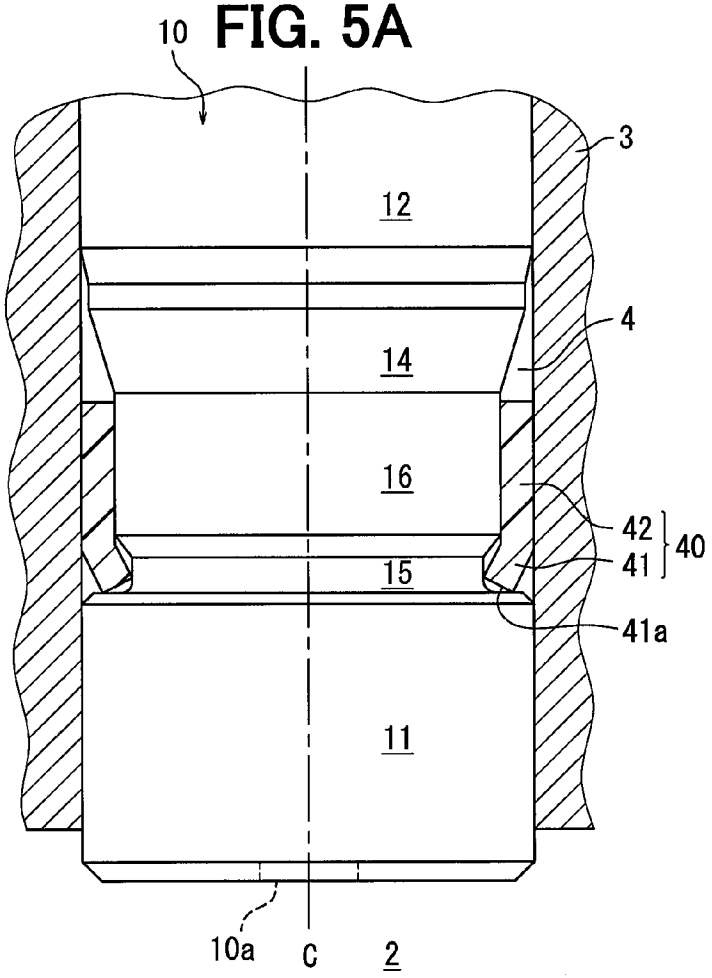
FIG. 5A is a chart showing an initial state in which the fuel injector has assembled to the internal combustion engine.

In step S30, the fuel injector 1 with the reformed seal ring 40 is inserted into the assembling hole 4. FIG. 5A shows an initial state in which an insertion of the fuel injector 1 has been completed. In this state, the tip end portion 41 is engaged with the annular groove 15, and the body portion 42 of the seal ring 40 is sandwiched between the inner surface 4*a* of the assembling hole 4 and the base diameter-shrink portion 16. The body portion 42 of the seal ring 40 is elastically deformed in its radial direction.

While the fuel injector 1 is inserted into the assembling hole 4, the outer surface of the seal ring 40 is rubbed by the inner surface 4*a* of the assembling hole 4. The seal ring 40 is pulled up by a friction force. However, since the tip end portion 41 is engaged with the annular groove 15, the tip end portion 41 remains in the annular groove 15 against the friction force.

In the above initial state, when a gas pressure in the combustion chamber 2 is applied to the seal ring 40, the seal ring 40 receives a force to push up the seal ring 40. This gas pressure is referred to as a gas-pushing force. The gas pressure is applied to the end surface 41*a*, the inner surface and the outer surface of the tip end portion 41. However, since the tip end portion 41 is engaged with the annular groove 15, the tip end portion 41 remains in the annular groove 15 against the gas-pushing force. At this moment, the tip end portion 41 is pushed to the base-side surface 15*c* and is compressively deformed. This deformed portion seals a clearance between the inner surface 4*a* of the assembling hole 4 and the outer surface of the body 10 (refer to step S40 in FIG. 3)

The gas pressure in the combustion chamber is further increased along with an increase of an engine load. When the gas pressure exceeds a specified value, the gas-pushing force is increased and the tip end portion 41 is disengaged from the annular groove 15. Such a state is referred to as an ordinary using state. As shown in FIG. 5B, the seal ring 40 is pushed up in the anti-injection-port direction. The tip end portion 41 moves on the base diameter-shrink portion 16 and the body portion 42 moves on the tapered portion 14. In the ordinary using state shown in FIG. 5B, a portion of the seal ring 40 on the tapered portion 14 is referred to as an ordinary body portion 42*x*, and a portion of the seal ring 40 on the base diameter-shrink portion 16 is referred to as an ordinary end portion 41*x*.

In the ordinary using state, the gas pressure is applied to the end surface 41*a* of the tip end portion 41 and the gas-pushing force is generated. Due to the gas-pushing force in the anti-injection-port direction, an ordinary body portion 42*x* is pressed against the tapered portion 14. As the result, whole of the seal ring 40 is compressively deformed to seal a clearance between the inner surface 4*a* of the assembling hole 4 and the outer surface of the body 10 (refer to step 50 in FIG. 3.)

According to the above embodiment, since the annular groove 15 is formed on the diameter-shrink portion 13 on which the seal ring 40 is disposed, the body 10 can be inserted into the assembling hole 4 with the tip end portion 41 engaged with the annular groove 15. Thus, it can be avoided that the body portion 42 of the seal ring 40 is pushed up to the tapered portion 14 by a friction force between the seal ring 40 and the assembling hole 4. It can be restricted that the body portion 42 is displaced from the tapered portion 14 toward the base portion 12. When the fuel injector 1 is inserted into the assembling hole 4, the seal ring 40 is not rubbed between the inner surface 4*a* of the assembling hole 4 and the tapered portion 14.

When the fuel injector 1 is pulled out from the assembling hole 4, the tip end portion 41 is engaged with the annular groove 15. Thus, it is avoided that the ordinary end portion 41*x* is pulled down to the injection-port portion 11. The tip end portion 41 is not displaced from a specified position of the diameter-shrink portion 13 toward the injection-port portion 11. Thus, the seal ring 40 is not stuck between the inner surface 4*a* of the assembling hole 4 and the outer surface of the injection-port portion 11. The fuel injector 1 is easily pulled out from the assembling hole 4.

The present embodiment has following features and advantages.

When the fuel injector 1 is inserted into the assembling hole 4, the outer diameter of the tip end portion 41 of the seal ring 40 is gradually decreased toward the injection port 10*a*. Thus, it is restricted that the outer surface of the tip end portion 41 is rubbed on the inner surface 4*a* of the assembling hole 4. The tip end portion 41 is not disengaged from the annular groove 15 due to the friction force.

Whole of the end surface 41*a* of the tip end portion 41 is positioned in the annular groove 15. When the fuel injector 1 is inserted into the assembling hole 4, the outer corner 41*c* of the tip end portion 41 is positioned in the annular groove 15. Thus, it is further restricted that the outer corner 41*c* is rubbed on the inner surface 4*a*. The tip end portion 41 is not disengaged from the annular groove 15 due to the friction force.

The tapered portion 14 is formed on the body 10 adjacent to the diameter-shrink portion 13 in the anti-injection-port direction. The outer diameter of the tapered portion 14 is gradually increased in the anti-injection-port direction. After the body 10 is inserted into the assembling hole 4, when the gas pressure of specified value or more is applied to the seal ring 40 in the ordinary using state, the seal ring 40 is pressed against the tapered portion 14 and is elastically deformed. This elastically deformed portion of the seal ring 40 seals the clearance between the inner surface 40 and outer surface of the body 10.

Since the seal member 40 is pressed against the tapered portion 14 by the gas-pushing force, the seal member 40 is compressively deformed in the axial direction. Compared with a case in which a shear force or tensile force is applied to the seal member 40, the seal member is less damaged.

After the body 10 is inserted into the assembling hole 4, in the above initial state, the seal ring 40 is sandwiched between the base-side surface 15*c* and the inner surface 4*a*. The seal ring 40 is compressively deformed to seal a clearance between the inner surface 4*a* and the outer surface of the body 10.

According to the above, in both of the initial state and the ordinary using state, the seal ring 40 can seal the clearance between the inner surface 4*a* and the outer surface of the body 10.

Before the body 10 is inserted into the assembling hole 4, the maximum diameter D40 of the seal ring 40 is larger than the inner diameter D4 of the inner surface 4*a* of the assembling hole 4.

According to the above, in both of the initial state and the ordinary using state, the outer surface of the seal ring 40 is in close contact with the inner surface 4*a*, and an inner surface of the seal ring 40 is in close contact with the outer surface of the body 10. A sealing efficiency of the seal ring 40 is improved.

Before the body 10 is inserted into the assembling hole 4, a most outer portion of the seal ring 40 on the diameter-shrink portion 13 is positioned radially outside relative to a most outer portion of the injection-port portion 11.

According to the above, in both of the initial state and the ordinary using state, the outer surface of the seal ring 40 is in close contact with the inner surface 4*a*, and an inner surface of the seal ring 40 is in close contact with the outer surface of the body 10. Thus, the sealing efficiency of the seal ring 40 is further improved.

The base-side surface 15*c* is tapered in such a manner that its outer diameter gradually increases in the anti-injection-port direction. If the base-side surface 15*c* is a right angle, it is likely that the tip end portion 41 is not disengaged when the seal ring 40 is pushed up by the gas-pushing force. On the other hand, according to the above feature, since the base-side surface 15*c* is tapered, the tip end portion 41 is smoothly disengaged from the annular groove 15 by the gas-pushing force.

In steps S10 and S20, even after the insertion of the injector 1 into the assembling hole 4, the tip end portion 41 is engaged with the annular groove 15. According to the above, the seal ring 40 is not displaced by the friction force, while the seal ring 40 is in middle of inserting into the assembling hole 4. Furthermore, in the initial state, the tip end portion 41 in the annular groove 15 is pressed against the base-side surface 15*c* and is compressively deformed. Thus, even in the initial state, the sealing efficiency of the seal ring 40 is ensured.

Second Embodiment

Figure 6B:
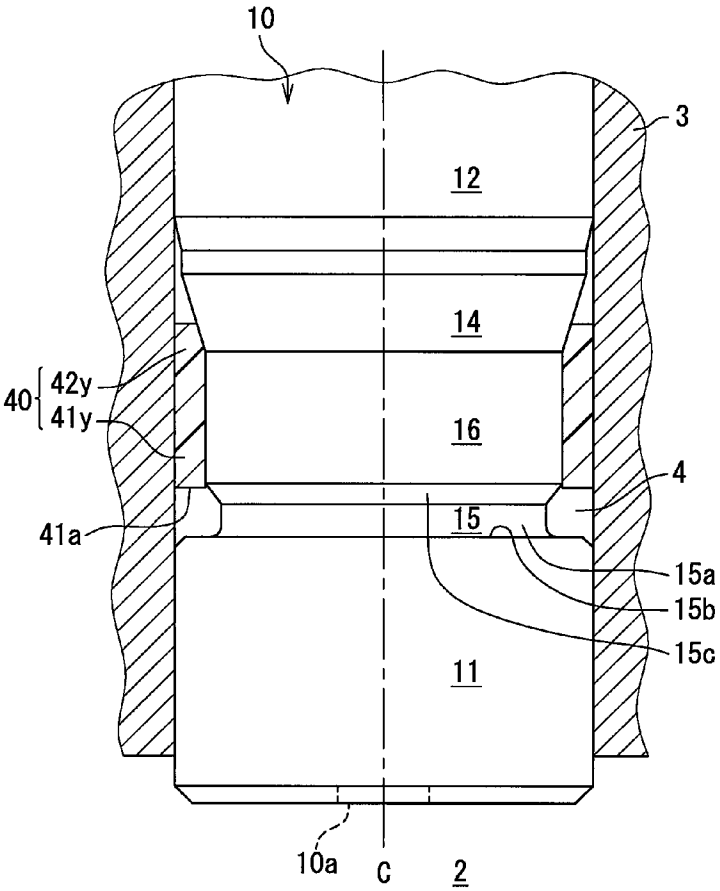
FIG. 6B is a chart showing an initial stated in which the insertion of the fuel injector has completed.
Figure 6A:
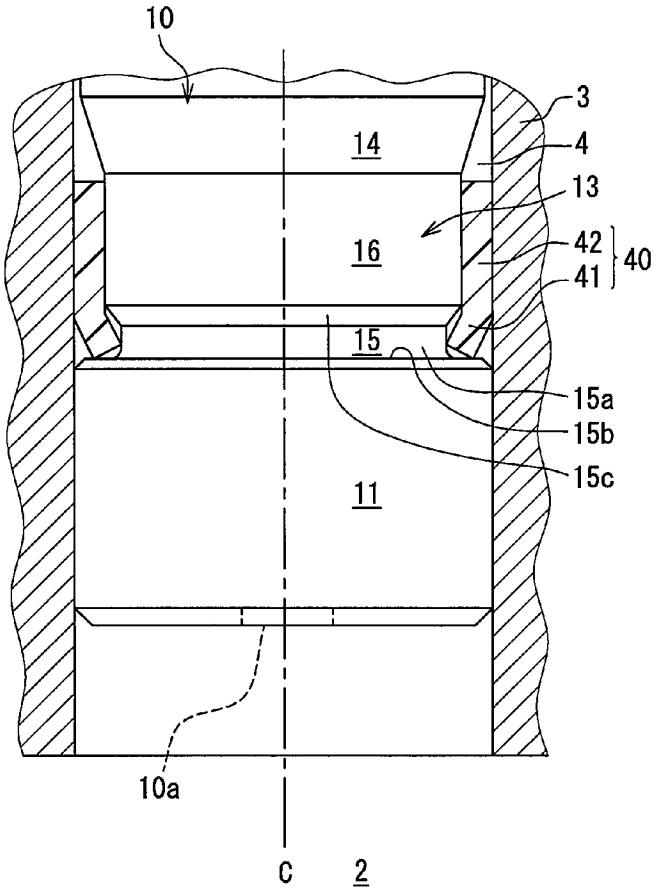
FIG. 6A is a chart showing a middle of insertion of the fuel injector to the assembling hole according to a second embodiment.

In the above first embodiment, when the insertion of the fuel injector 1 into the assembling hole 4 is completed, the tip end portion 41 is engaged with the annular groove 15. According to the second embodiment, in a middle of insertion of the fuel injector 1, the tip end portion 41 is engaged with the annular groove 15, as shown in FIG. 6A. When the insertion of the fuel injector 1 is completed, the tip end portion 41 is disengaged from the annular groove 15, as shown in FIG. 6B.

It is preferable that a disengage timing from the annular groove 15 is late as much as possible. For example, it is preferable that when a remaining insert amount is less than an axial length of the tapered portion 14, the tip end portion 41 is disengaged from the annular groove 15.

In order to disengage the tip end portion 41 in a middle of insertion of the fuel injector 1, a surface roughness of the base diameter-shrink portion 16, a surface roughness of the annular groove 15, a surface roughness of the seal ring 40, a tapered angle of the base-side surface 15*c*, an elastic coefficient of the seal ring 40 and an elastic deformation amount of the seal ring 40 are adjusted.

According to the second embodiment, after the insertion of the body 10 into the assembling hole 4 is completed, the tip end portion 41 is disengaged from the annular groove 15 in the initial state. Thus, the seal ring 40 is sandwiched between the base diameter-shrink portion 16 and the inner surface 4*a* of the assembling hole 4, and is compressively deformed. This compressively deformed portion seals the clearance between inner surface 4*a* and the outer surface of the body 10, as shown in FIG. 6B.

In the middle of the insertion of the fuel injector 1, the seal ring 40 is engaged with the annular groove 15, so that the seal ring 40 is not pushed up by the friction force. When the insertion of the fuel injector 1 is completed, the seal ring 40 is disengaged from the annular groove 15. The seal ring 40 receives the gas pressure at only the end surface 41*a*. Compared with the first embodiment shown in FIG. 5A, a gas-pressure receiving area of the seal ring 40 can be reduced. Thus, the seal ring 40 receives less heat from the gas in the combustion chamber 2.

Third Embodiment

Figure 7:
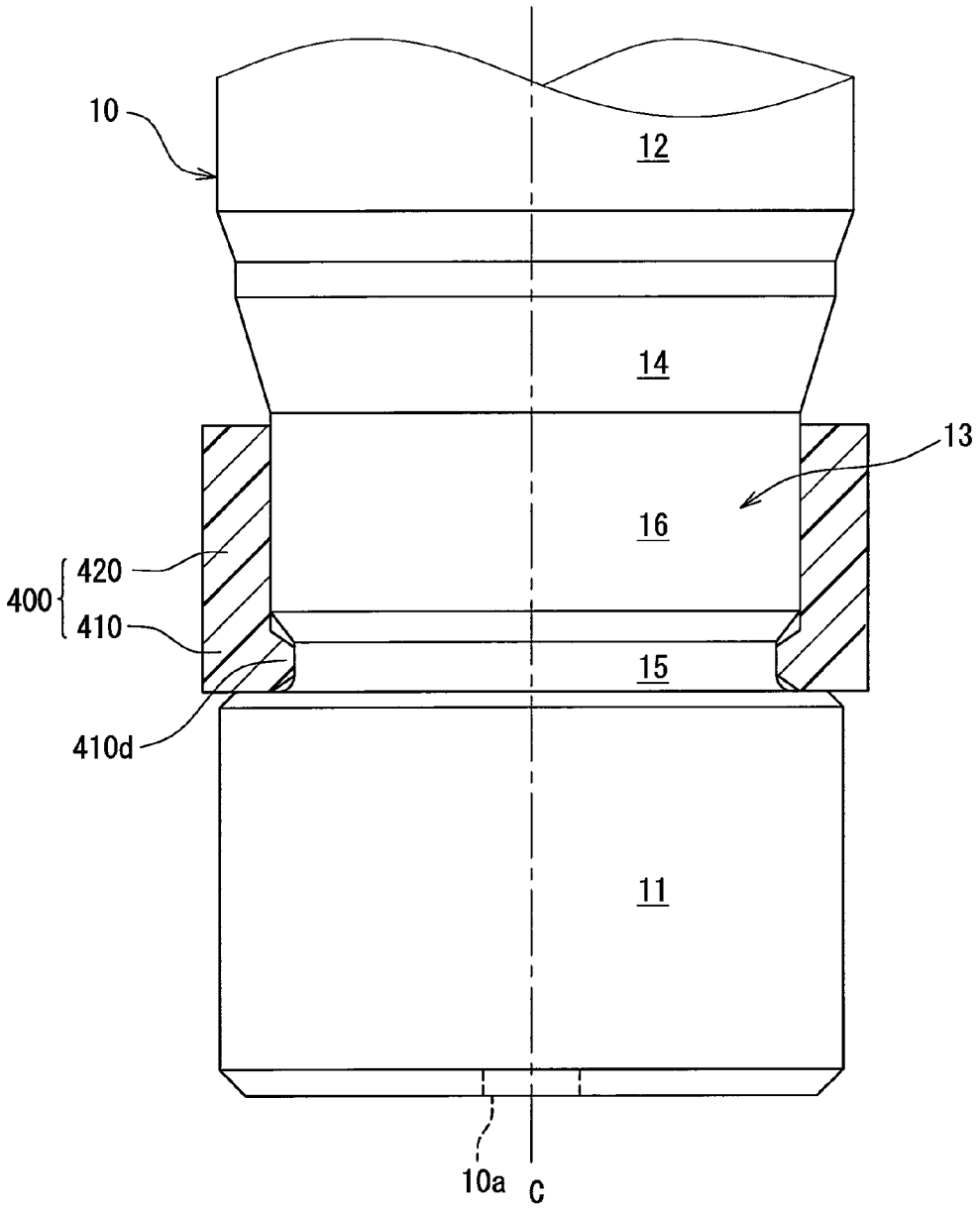
FIG. 7 is a chart showing a part of the fuel injector which is not assembled to an assembling hole according to a third embodiment.

In the first embodiment, in a condition where the seal ring 40 is disposed on the diameter-shrink portion 13 and the fuel injector 1 has not been inserted into the assembling hole 4, the thickness of the seal ring 40 is uniform. According to the third embodiment, as shown in FIG. 7, the thickness of the seal ring 400 is non-uniform. The reform step in step S20 is unnecessary.

The seal ring 400 has a tip end portion 410 and a body portion 420. The tip end portion 410 is engaged with the annular groove 15 and the body portion 420 is engaged with the base diameter-shrink portion 16. A thickness of the body portion 420 is uniform. A thickness of the tip end portion 410 is larger than that of the body portion 420.

In other words, an outer diameter of the tip end portion 410 is equal to an outer diameter of the body portion 420. An inner diameter of the tip end portion 410 is smaller than an inner diameter of the body portion. That is, the tip end portion 410 has a protruding portion 410*d* which protrudes radially inward. The protruding portion 410*d* is engaged with the annular groove 15.

According to the present embodiment, the same advantages as the first embodiment can be achieved. That is, since the annular groove 15 is formed on the diameter-shrink portion 13 on which the seal ring 40 is disposed, the body 10 can be inserted into the assembling hole 4 with the protruding portion 410*d* engaged with the annular groove 15. Thus, it can be avoided that the body portion 420 of the seal ring 400 is pushed up to the tapered portion 14 by a friction force between the seal ring 400 and the assembling hole 4. It can be restricted that the body portion 420 is displaced from the tapered portion 14 in the anti-injection-port direction. Therefore, it is avoided that the seal ring 400 is strongly rubbed and is damaged.

When the fuel injector 1 is pulled out from the assembling hole 4, the protruding portion 410*d* is engaged with the annular groove 15. Thus, it is avoided that the seal ring 400 is pulled down by the friction force. The tip end portion 410 is not displaced from a specified position of the diameter-shrink portion 13 toward the injection-port portion 11. Thus, the seal ring 400 is not stuck between the inner surface 4*a* of the assembling hole 4 and the outer surface of the injection-port portion 11. The fuel injector 1 is easily pulled out from the assembling hole 4.

Since the seal ring 400 has the protruding portion 41*d*, the reform step in step S20 is unnecessary.

Fourth Embodiment

Figure 8:
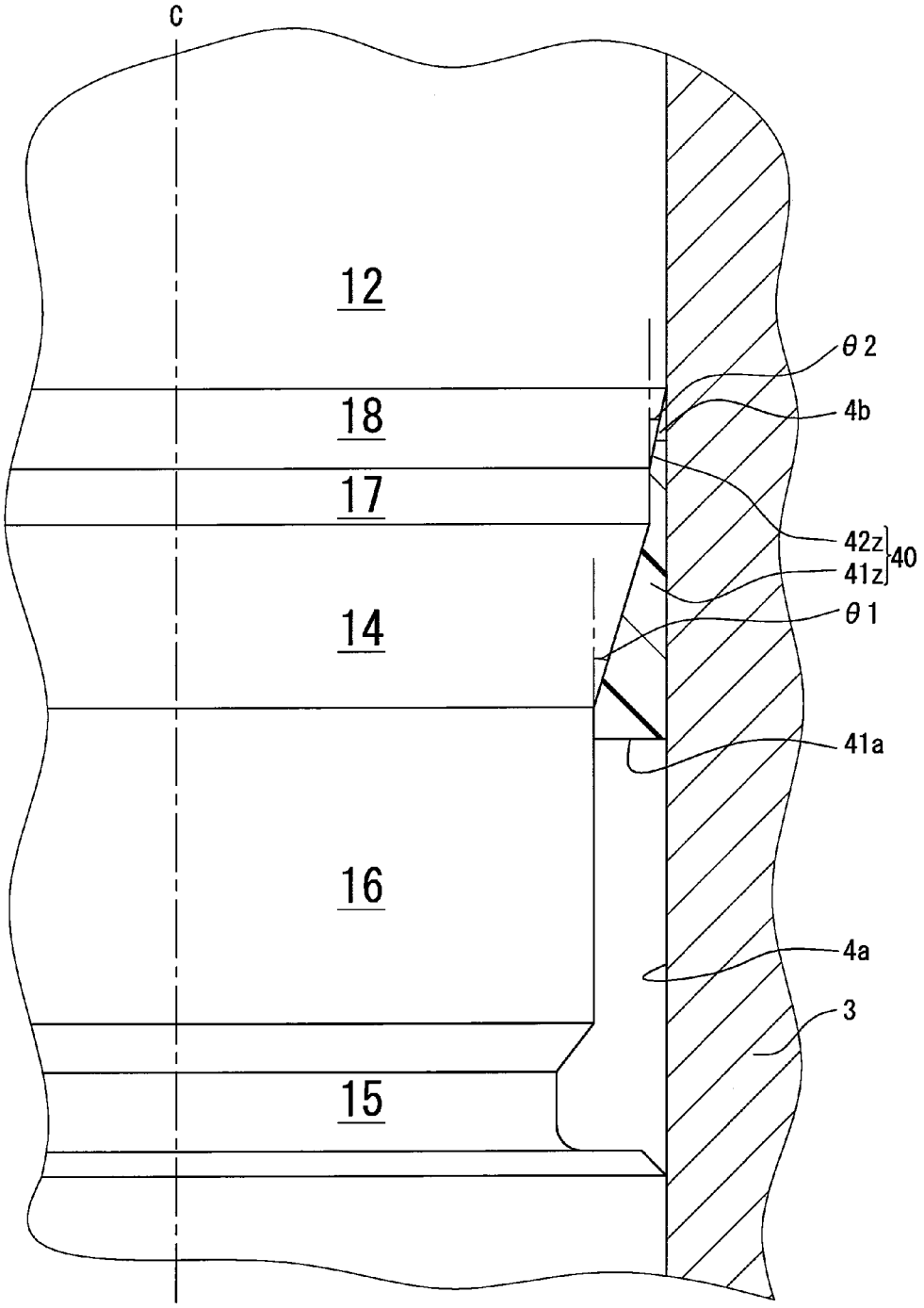
FIG. 8 is a chart showing an ordinary using state in which a gas-pressure is applied to the seal ring of the fuel injector according to a fourth embodiment.

According to the fourth embodiment, the taper angle θ1 of the tapered portion 14 is established in a range from 10° to 20°. Referring to FIG. 8, an operation and a configuration of the body 10 will be described.

The body 10 has a straight portion 17 and a sub-tapered portion 18 which extend from the tapered portion 14 in the anti-injection-port direction. The straight portion 17 is positioned between the tapered portion 14 and the sub-tapered portion 18. The base portion 12 extends from the sub-tapered portion 18 in the anti-injection-port direction. Outer diameters of the tapered portion 14, the straight portion 17 and the sub-tapered portion 18 are smaller than that of the base portion 12. The straight portion 17 and the sub-tapered portion 18 correspond to a second diameter-shrink portion.

An outer diameter of the straight portion 17 is uniform in the axial direction of the body 10. An axial length of the sub-tapered portion 18 is shorter than that of the tapered portion 14. The annular groove 15, the base diameter-shrink portion 16, the tapered portion 14, the straight portion 17 and the sub-tapered portion 18 are formed in such a manner that their surface roughnesses are equal to each other. Further, the body 10 is formed in such a manner that the surface roughness of the tapered portion 14 is smaller than that of a portion accommodating the electric actuator 30.

Outer diameters of the tapered portion 14 and the sub-tapered portion 18 are gradually increased in anti-injection-port direction. Outer diameters of the base diameter-shrink portion 16 and the straight portion 17 are uniform.

The taper angle θ1 of the tapered portion 14 and a taper angle θ2 of the sub-tapered portion 18 are established in a range from 10° to 20°. Specifically, the taper angles θ1 and θ2 are set to 15°. Besides, the taper angle represents an angle at which a virtual line axially extending in cross section of the body 10 intersects an outer line of the body 10. A taper angle of the base-side surface 15*c* is larger than the taper angles θ1 and θ2. Taper angles of the base diameter-shrink portion 16, the straight portion 17 and the bottom surface 15*a* are zero.

When the ordinary using state (S50) is continued for a long time period, the seal ring 40 deteriorates due to the creep phenomenon and a contact pressure of the seal ring 40 is decreased. However, if the seal ring 40 is deteriorated, the seal ring 40 is further pushed up and the radial deform amount of the seal ring 40 is increased. Even though the contact pressure of the seal ring 40 is decreased due to the creep phenomenon, the radial deform amount is increased, so that the contact pressure of the seal ring 40 in the ordinary using state can be maintained. Thus, a sealing ability due to a wedge effect is maintained.

When the ordinary using state is further continued and the seal ring 40 further deteriorates, the seal ring 40 is pushed up by gas-pushing force and a part of the ordinary body portion 42*x* is inserted into a retract chamber 4*b*. The retract chamber 4*b* is a clearance formed between the straight portion 17, the sub-tapered portion 18 and the inner surface 4*a* of the assembling hole 4.

As the result, the seal ring 40 is sandwiched between the inner surface 4*a* and the sub-tapered portion 18. A part of the ordinary body portion 42*x* is positioned on the sub-tapered portion 18 and a part of the ordinary end portion 41*x* is positioned on the straight portion 17. In an retract state shown in FIG. 8, a part of the seal ring 40 on the sub-tapered portion 18 is referred to as an retract body portion 42*z*, and a part of the seal ring 40 on the straight portion 17 is referred to as an retract end portion 41*z*.

In the above retract state, a gas pressure is applied to an end surface 41*a* of the retract end portion 41*z*. The gas-pushing force is applied to the end surface 41*a*. Due to this gas-pushing force, the retract body portion 42*z* and the retract end portion 41*z* are respectively pressed against the sub-tapered portion 18 and the tapered portion 14. As the result, a wedge effect is obtained on the sub-tapered portion 18 in addition to the tapered portion 14. Thereby, a clearance between the inner surface 4*a* and the outer surface of the body 10 (tapered portion 14 and sub-tapered portion 18) is sealed. This state is referred to a retract state.

Between an outer surface of the base portion 12 and the inner surface 4*a* of the assembling hole 4, a clearance is formed to insert the body 10 into the assembling hole 4. However, the retract body portion 42*z* can not extend into the clearance. If the retract body portion 42*z* extends to a boundary between the sub-tapered portion 18 and the base portion 12, the contact pressure can not be ensured and the sealing ability is deteriorated. In view of this, the fuel injector 1 is replaced before the retract body portion 42*z* extends to a boundary The above described embodiment has following features and advantages.

The taper angle θ1 of the tapered portion 14 is established in a range from 10° to 20°. Referring to experimental results shown in FIGS. 9 and 10, the effects will be explained.

Figure 9:
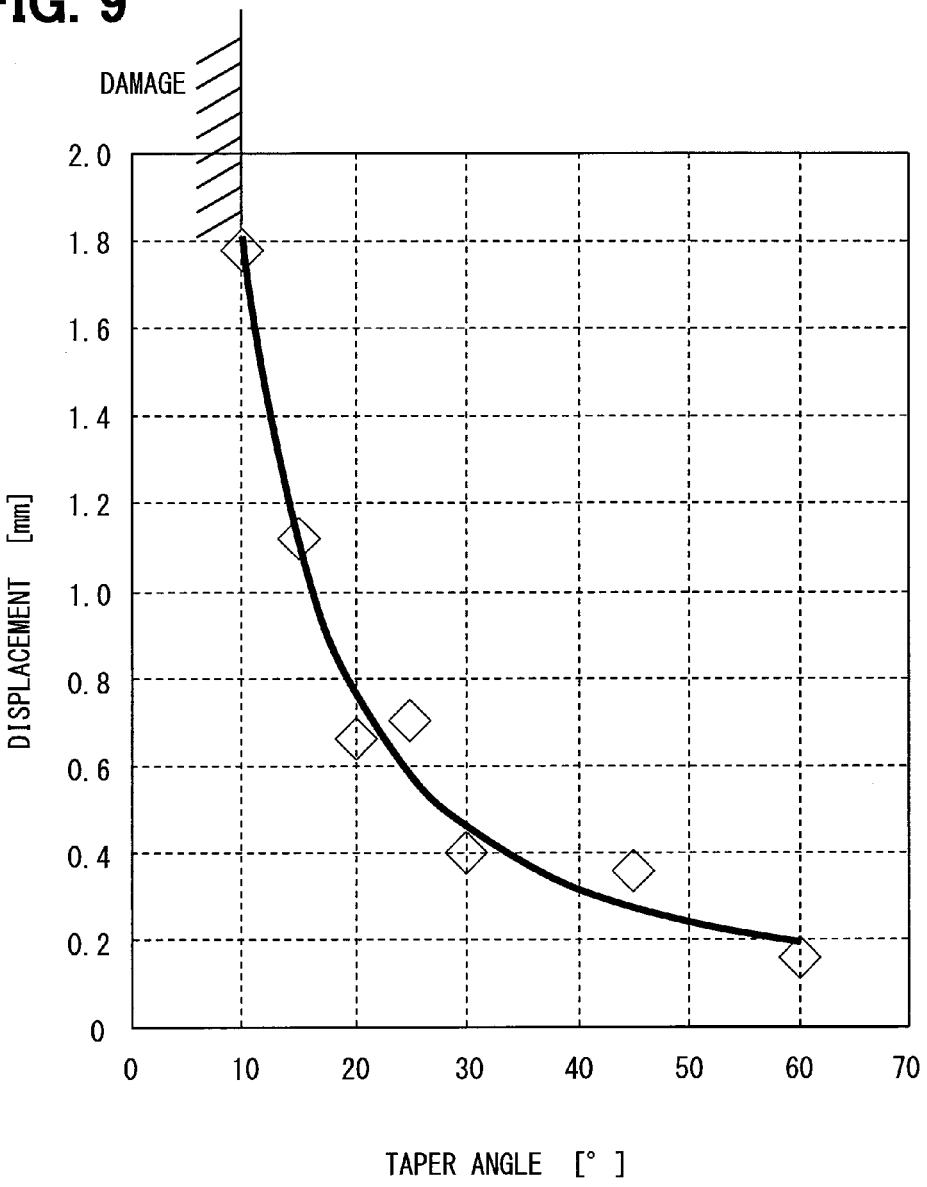
FIG. 9 is a graph showing a relationship between a displace distance of the seal ring and a taper angle.
Figure 10:
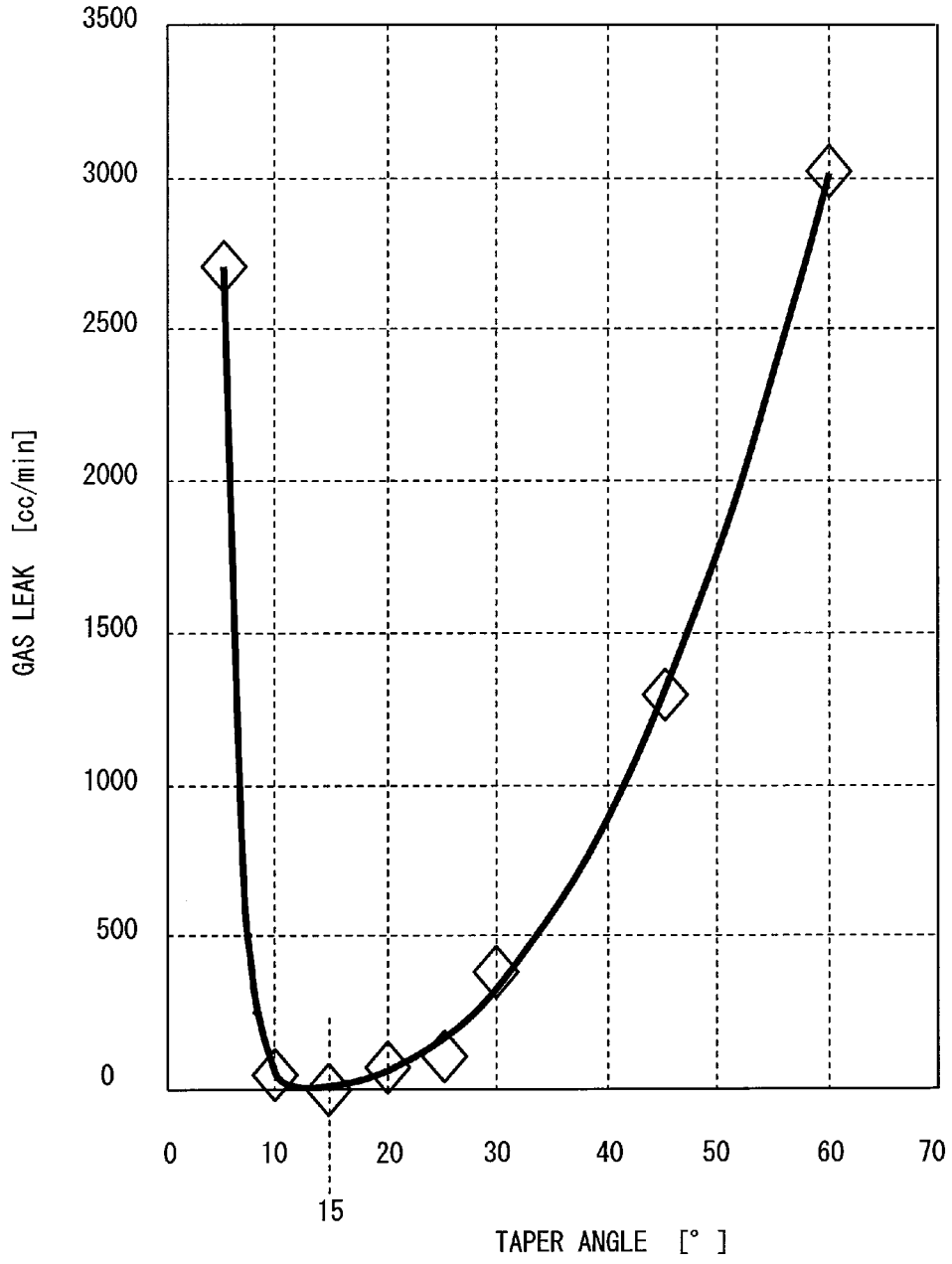
FIG. 10 is a graph showing a relationship between a gas leak amount and a taper angle.

In FIG. 9, a vertical axis represents a displace distance by which the end surface 41*a* of the seal ring 40 is moved after the body 10 is inserted into the assembling hole 4. In FIG. 10, a vertical axis represents an amount of gas leaked from the seal ring 40 after the fuel injector 1 is inserted into the assembling hole 4.

In FIGS. 9 and 10, horizontal axes represent the taper angle of the tapered portion 14. In an experiment of which result is shown in FIG. 9, when the taper angle of the tapered portion 14 becomes 5°, the seal ring 40 is broken and the displace distance can not be measured. Meanwhile, in an experiment of which result is shown in FIG. 10, even when the taper angle of the tapered portion 14 becomes 5°, the seal ring 40 is not broken. In the former experiment, the fuel injector having a maximum dimensional tolerance is used, and the latter experiment, the fuel injector having a minimum dimensional tolerance is used.

The experimental result shown in FIG. 9 shows that when the taper angle greater than or equal to 10°, the displace distance of the seal ring 40 is restricted so that the seal ring 40 is not damaged. The experimental result shown in FIG. 10 shows that when the taper angle less than or equal to 20°, the sealing ability due to the wedge effect can be sufficiently obtained.

Therefore, according to the present embodiment, since the taper angle θ1 is 10° or more and 20° or less, the displacement of the seal ring 40 is restricted and the sealing ability due to the wedge effect can be improved.

On the body 10, the second diameter-shrink portion (the straight portion 17 and the sub-tapered portion 18) is formed. This second diameter-shrink portion forms the retract chamber 4*b*.

In a case that the contact pressure of the seal ring 40 is deteriorated due to the creep phenomenon, the wedge effect can not be obtained after the seal ring 40 slides up on the tapered portion 14. In view of this, according to the present embodiment, since the second diameter-shrink portion extends from the tapered portion 14, the retract chamber 4*b* can be formed adjacent to the tapered portion 14 in the in the anti-injection-port direction. Thus, even after the ordinary body portion 42*x* of the seal ring 40 slides on the tapered portion 14, the ordinary body portion 42*x* can be introduced into the retract chamber 4*b*. Thus, the wedge effect can be obtained for long time period, and a life time of the seal ring is prolonged.

The second diameter-shrink portion includes the straight portion 17 of which outer diameter is uniform in the axial direction. Thus, the retract chamber 4*b* can be formed without enlarging the body in the radial direction.

The second diameter-shrink portion includes the sub-tapered portion 14. The straight portion 17 is positioned between the tapered portion 14 and the sub-tapered portion 18.

Thus, the ordinary body portion 42*x* in the retract chamber 4*b* is further pressed to the sub-tapered portion 18, so that the wedge effect is performed. The sealing ability of the seal ring 40 can be improved.

The taper angle θ2 of the sub-tapered portion 18 is in a range from 10° to 20°. Thus, on the sub-tapered portion 18, the seal ring 40 is restricted to displace and the sealing ability due to the wedge effect is improved.

The body 10 is worked in such a manner that the surface roughness of the tapered portion 14 is smaller than that of the part of the body 10 accommodating the electric actuator 30.

Since the surface roughness of the tapered portion 14 is small, the contact between the tapered portion 14 and the seal ring 40 is improved. The sealing ability between the seal ring 40 and the body 10 can be improved. When the surface roughness of the tapered portion 14 is small, it is likely that the seal ring 40 slide up on the body 10. In order to restrict the slide up of the seal ring 40, the taper angle θ1 is greater than or equal to 10°.

Fifth Embodiment

Figure 11:
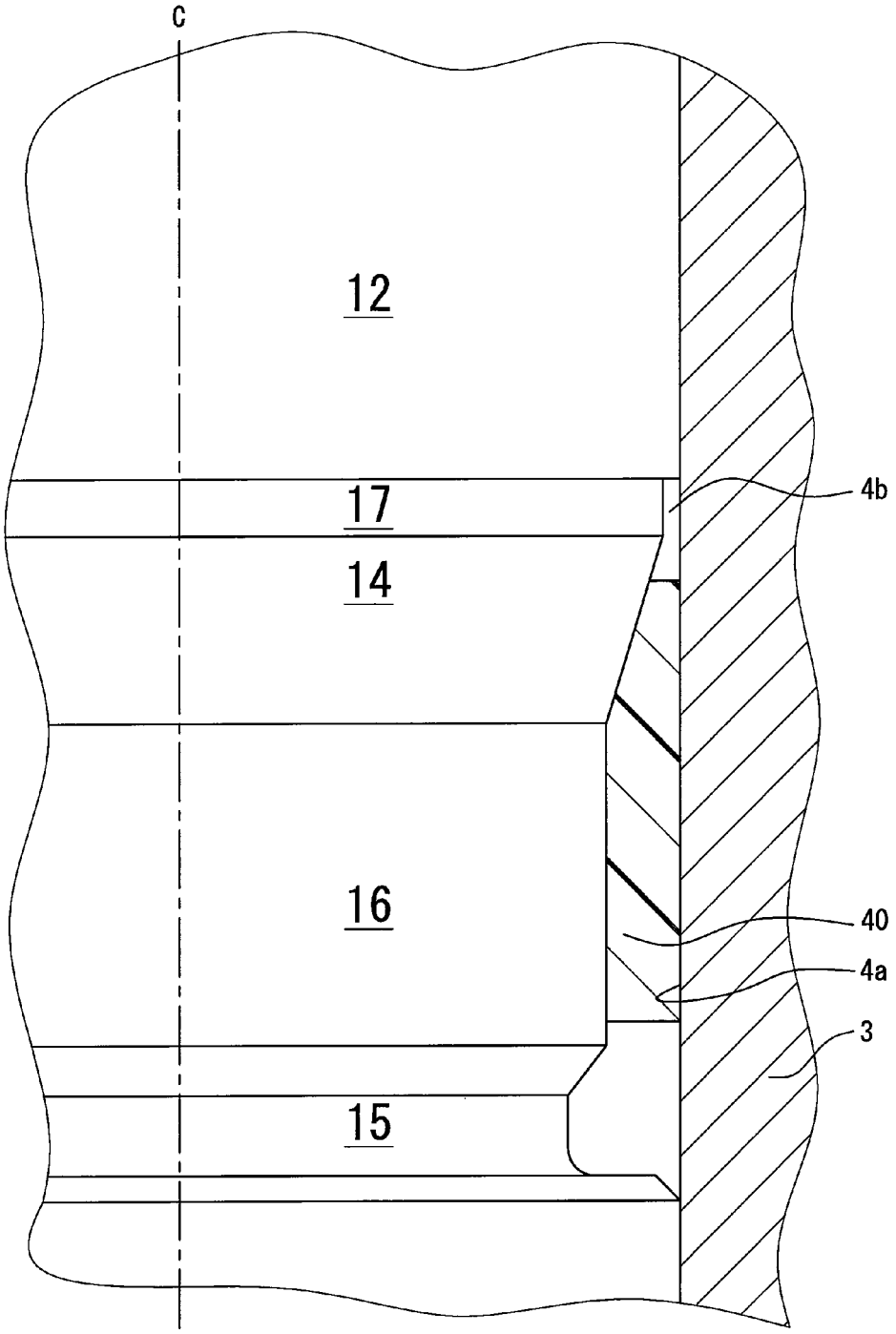
FIG. 11 is a chart showing an ordinary using state in which a gas-pressure is applied to the seal ring of the fuel injector according to a fifth embodiment.

In the above forth embodiment, the body 10 has the sub-tapered portion 18. According to the fifth embodiment shown in FIG. 11, the body 10 does not have sub-tapered portion. That is, the body 10 has the base diameter-shrink portion 16, the tapered portion 14, the straight portion 17 and the base portion 12 in this series. The straight portion 17 is positioned between the tapered portion 14 and the base portion 12. In this configuration, the straight portion 17 corresponds to the second diameter-shrink portion. A clearance between the inner surface 4*a* of the assembling hole 4 and the straight portion 17 functions as the retract chamber 4*b*.

As above, even if the sub-tapered portion 18 is not formed, the straight portion 17 defines the retract chamber 4*b*. Thus, even after the seal ring 40 slides on the tapered portion 14, the end of the seal ring 40 can be retracted in the retract chamber 4*b*. Thus, the wedge effect can be obtained for long time period, and a life time of the seal ring is prolonged.

Sixth Embodiment

Figure 12:
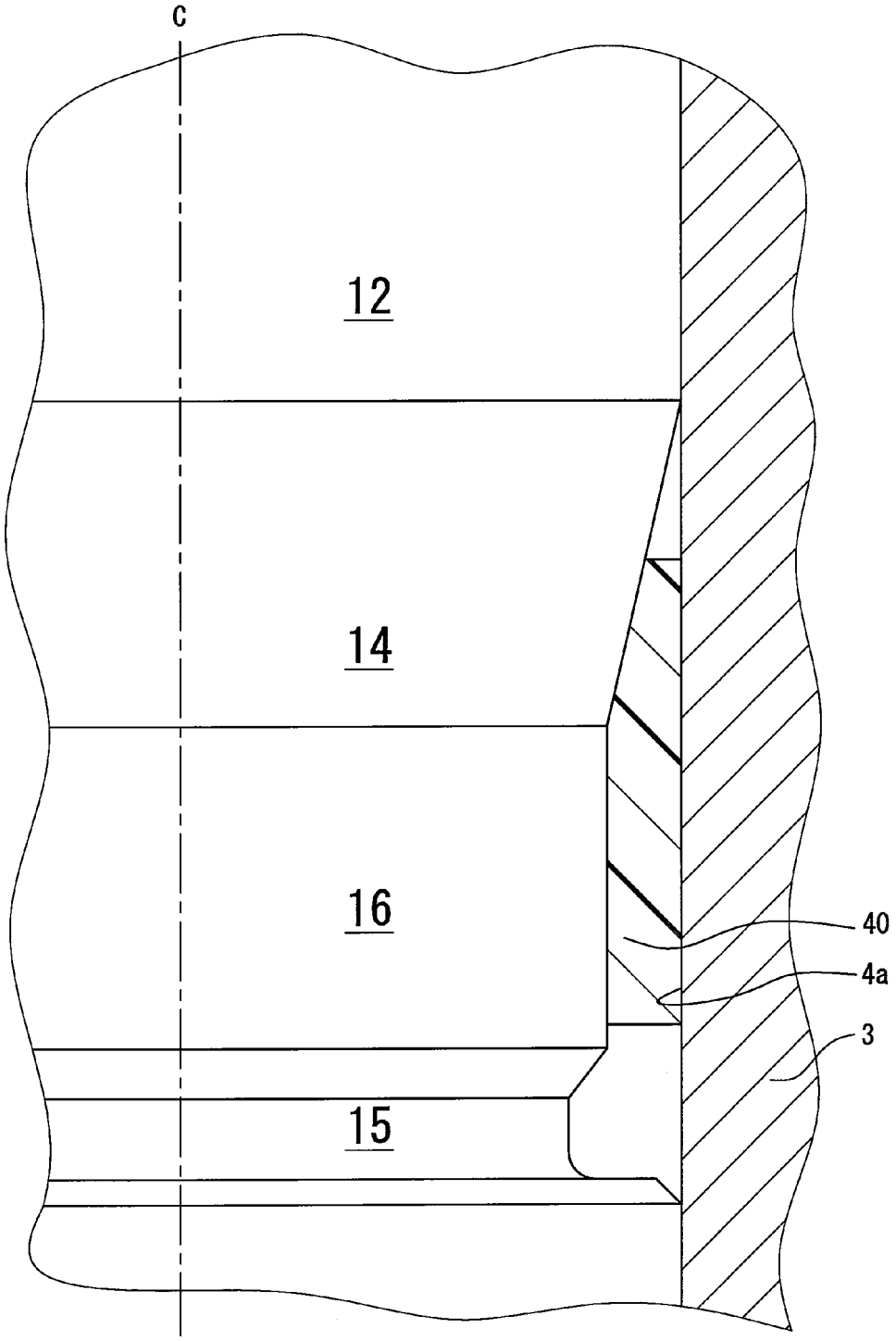
FIG. 12 is a chart showing an ordinary using state in which a gas-pressure is applied to the seal ring of the fuel injector according to a sixth embodiment.

In the sixth embodiment shown in FIG. 12, the body 1 does not have the sub-tapered portion 18 and the straight portion 17 unlike the fourth embodiment. That is, the body 10 has the base diameter-shrink portion 16, the tapered portion 14 and the base portion 12 in this series. The tapered portion 14 is positioned between the base diameter-shrink portion 16 and the base portion 12

In the above configuration where the sub-tapered portion 18 and the straight portion 17 are not formed, the retract chamber 4*b* does not exist. Thus, although the sealing ability is not improved, the cutting work of sub-tapered portion 18 and the straight portion 17 becomes unnecessary.

Other Embodiment

The present invention is not limited to the embodiments described above, but may be performed, for example, in the following manner. Further, the characteristic configuration of each embodiment can be combined.

A shape of the seal ring 40 of the first embodiment and a shape of the seal ring 400 of the third embodiment may be combined. That is, the tip end portion 410 has the protruding portion 410*d*, and the outer diameter is gradually decreased.

The base-side surface 15*c* of the annular groove 15 may be shaped as a curvature.

The fuel injector 1 may be provided to a cylinder block. The fuel injector 1 can be used for a diesel engine. The fuel injector 1 may inject fuel into an intake pipe.

In a configuration of the first embodiment, the annular groove 15 may not be formed. The base diameter-shrink portion 16 may be continuously formed from the injection-port portion 11. Compared with a configuration having annular groove 15, the seal ring 40 is easily displaced. However, since the taper angle θ1 of the tapered portion 14 is 10° or more, the displacement of the seal ring 40 is restricted.

In the fourth embodiment, the base diameter-shrink portion 16 and the tapered portion 14 have the same surface roughness. However, the surface roughness of the tapered portion 14 may be smaller than that of the base diameter-shrink portion 16. Thereby, the contact between the tapered portion 14 and the seal ring 40 is made higher, and the sealing ability between the seal ring 40 and the tapered portion 14 is improved. The taper angle θ1 can be set larger, and the displacement amount of the seal ring 40 can be reduced.

In the fourth embodiment, the taper angle θ1 and the taper angle θ2 are set in a rage from 10° to 20°. However, these taper angles may be set out of the above range.

In the fourth embodiment, the surface roughness of the tapered portion 14 is smaller than that of the part of the body 10 accommodating the electric actuator 30. However, the surface roughness may be set equal to each other.

What is claimed is:

1. A fuel injector comprising:

a body having a fuel injection port, and a seal ring sealing a clearance between an outer surface of the body and an inner surface of an assembling hole into which the body is inserted to inject a fuel into an internal combustion engine, wherein:

the body has a diameter-shrink surface of which an outer diameter is shrunk, the diameter-shrink surface has a radially concaved annular groove surface with which a tip end portion of the seal ring is engaged, the diameter-shrink surface has a base diameter-shrink surface of which outer diameter is larger than that of the radially concaved annular groove surface and is constant in an axial direction of the diameter-shrink surface, the body has a tapered surface of which outer diameter is gradually increased toward the body, the seal ring is made from elastic resin material having a thermal resistance to heat, and after the body is inserted into the assembling hole, when the gas pressure is applied to the seal ring, the seal ring is pushed to the tapered surface and is elastically deformed on the tapered surface so that the seal ring seals a clearance between the outer surface of the body and the inner surface of an assembling hole.

2. A fuel injector according to claim 1, wherein:

an outer diameter of the tip end portion gradually decreases toward the fuel injection port.

3. A fuel injector according to claim 1, wherein:

an entirety of an end surface of the tip end portion is positioned in the radially concaved annular groove surface.

4. A fuel injector according to claim 1, wherein:

a taper angle of the tapered surface is in a range from 10° to 20°.

5. A fuel injector according to claim 4, wherein:

the body has a second diameter-shrink surface adjacent to the tapered surface in such a manner as to form a clearance between the outer surface of the body and the inner surface of an assembling hole.

6. A fuel injector according to claim 5, wherein:

the second diameter-shrink surface includes a straight surface of which an outer diameter is uniform in an axial direction of the body.

7. A fuel injector according to claim 6, wherein:

the second diameter-shrink surface includes a sub-tapered surface of which an outer diameter gradually increases in the anti-injection-port direction, and the straight surface is positioned between the tapered surface and the sub-tapered surface.

8. A fuel injector according to claim 7, wherein:

a taper angle of the sub-tapered surface is in a range from 10° to 20°.

9. A fuel injector according to claim 4, wherein:

the body accommodates a valve opening/closing the fuel injection port and an electric actuator generating a magnetic attraction force to drive the valve; and a surface roughness of the tapered surface is smaller than that of a part of the body accommodating the electric actuator.

10. A fuel injector according to claim 1, wherein:

a base-side surface of the radially concaved annular groove surface is tapered in such a manner that an outer diameter of the base-side surface gradually increases in the anti-injection-port direction.

11. A fuel injector according to claim 1, wherein:

after the body is inserted into the assembling hole, in a condition where the predetermined gas pressure is not applied to the seal ring, the seal ring is sandwiched between the radially concaved annular groove surface and the inner surface of an assembling hole so that the seal ring seals the clearance between the outer surface of the body and the inner surface of an assembling hole.

12. A fuel injector according to claim 1, wherein:

after the body is inserted into the assembling hole, in a condition where the predetermined gas pressure is not applied to the seal ring and the tip end portion is disengaged from the radially concaved annular groove surface, the seal ring is sandwiched between the radially concaved annular groove surface and the inner surface of an assembling hole so that the seal ring seals the clearance between the outer surface of the body and the inner surface of an assembling hole.

13. A fuel injector according to claim 1, wherein:

before the body is inserted into the assembling hole, a maximum outer diameter of the seal ring is larger than an inner diameter of the assembling hole.

14. A fuel injector according to claim 1, wherein:

before the body is inserted into the assembling hole, a most outer portion of the seal ring on the diameter-shrink surface is positioned radially outside relative to a most outer portion of the radially concaved annular groove surface.

15. A fuel injector according to claim 1, wherein:

the seal ring is includes the tip end portion and a body portion, and a thickness of the tip end portion is larger than that of the body portion in radially inward direction.

16. A fuel injector according to claim 1, wherein the seal ring is made of fluororesin.

* * * * *